US005161511A

United States Patent [19]

Ketterer

[11] Patent Number: 5,161,511

[45] Date of Patent: Nov. 10, 1992

[54] APPARATUS FOR INJECTING A FUEL-GAS MIXTURE

[75] Inventor: Wolfgang Ketterer, Ludwigsburg-Neckarweihingen, Fed. Rep. of Germany

[73] Assignee: Robert Bosch GmbH, Stuttgart, Fed. Rep. of Germany

[21] Appl. No.: 778,193

[22] PCT Filed: Apr. 4, 1991

[86] PCT No.: PCT/DE91/00283

§ 371 Date: Jan. 6, 1992

§ 102(e) Date: Jan. 6, 1992

[87] PCT Pub. No.: WO91/17358

PCT Pub. Date: Nov. 14, 1991

[30] Foreign Application Priority Data

May 4, 1990 [DE] Fed. Rep. of Germany ..... 4014245

[51] Int. Cl.[5] ..... F02M 23/00

[52] U.S. Cl. ..... 123/531

[58] Field of Search ..... 123/531, 472, 510, 511, 123/514, 494, 585; 239/403, 464, 406

[56] References Cited

U.S. PATENT DOCUMENTS

| | | | |
|---|---|---|---|
| 4,434,766 | 3/1984 | Matsuoka et al. | 123/472 |
| 4,945,877 | 8/1990 | Ziegler et al. | 123/531 |
| 4,982,716 | 1/1991 | Takada et al. | 123/531 |
| 5,027,778 | 7/1991 | Noki et al. | 123/531 |
| 5,080,079 | 1/1992 | Yoshida et al. | 123/531 |
| 5,102,054 | 4/1992 | Halvorsen | 239/406 |

*Primary Examiner*—Raymond A. Nelli

*Attorney, Agent, or Firm*—Edwin E. Greigg; Ronald E. Greigg

[57] ABSTRACT

In known equipment for injecting a fuel-gas mixture, the danger exists of an asymmetrical effect on the fuel stream from the delivered gas, with resultant poor mixture formation. The novel apparatus has a fuel injection valve, the injection end of which rests on a bearing face of the longitudinal bore of the valve holder. Between the injection end and the bearing, an annular gas conduit is formed, from which at least two gas gaps originate, having opposed gap openings discharging into the mixing line. The symmetrical delivery of the gas to the centrally injected fuel stream leads to the formation of a maximally homogeneous fuel-gas mixture. The embodiment of the apparatus is especially suitable for use in mixture-compressing internal combustion engines with externally supplied ignition.

16 Claims, 3 Drawing Sheets

APPARATUS FOR INJECTING A FUEL-GAS MIXTURE

BACKGROUND OF THE INVENTION

The invention is based on an apparatus for injecting a fuel-gas mixture as defined hereinafter. German Offenlegungsschrift 36 09 798 already discloses an apparatus for injecting a fuel-gas mixture, in which a fuel injection valve is surrounded by a stepped longitudinal bore of a valve holder. Downstream of an injection end of the fuel injection valve in the valve holder is a mixing line that communicates upstream, via a gas gap formed between the injection end and the longitudinal bore, with an annular gas conduit that communicates with a gas source. However, this apparatus has the disadvantage that the gas is delivered to the annular gas conduit through a single line and flows downstream into the mixing line through the gas gap. The danger thus exists that the fuel stream will be asymmetrically affected by the delivered gas, so that a fuel film forms on the walls of the mixing line. Accordingly, the formation of a maximally homogeneous fuel-gas mixture is not assured.

The size of the annular gas gap and the quality of centering of the fuel injection valve also depend on tolerances in the length and shape of both the fuel injection valve and the longitudinal bore of the valve holder.

ADVANTAGES OF THE INVENTION

The apparatus according to the invention has an advantage over the prior art that the fuel stream is not asymmetrically affected, because of the symmetrical delivery of the gas through the at least two opposed gap openings of the gas gap into the mixing line. Thus there is less danger that a fuel film will form on the walls of the mixing line, and the formation of a maximally homogeneous fuel-gas mixture is assured. Moreover, the apparatus has a particularly compact structure and is simple to manufacture.

By means of the characteristics recited hereinafter, advantageous further developments of and improvements to the apparatus for injecting a fuel-gas mixture as defined are possible.

For the simplest possible embodiment of the valve holder, it is advantageous if two gas gaps originate at the annular gas conduit.

It is especially advantageous if the center lines of the two gas gaps each, discharging with opposed gap openings into the mixing line, are located in a plane through the longitudinal valve axis, so that a uniform, symmetrical inflow of the gas through the gas gaps to the gap openings discharging into the mixing line takes place.

For a particularly calm and uniform inflow of the gas through the gas gaps into the mixing line, it is advantageous if the annular gas conduit is embodied at least semicircularly.

It is advantageous if the bearing face of the longitudinal bore and the injection end of the fuel injection valve are embodied to taper frustoconically, radially to the longitudinal valve axis, so that the position of the injection end to the mixing line is defined in a simple manner immediately at the injection end itself. This assures accurate embodiment of the gas gaps, central injection of the fuel, and hence the formation of a maximally homogeneous fuel-gas mixture. Additionally, the gas gaps are inclined relative to the longitudinal valve axis in the downstream direction, so that any fuel deposited on the wall of the mixing line is torn off and entrained at high speed by the gas flowing downstream.

It is also advantageous if branching off from the mixing line is a regulator gap that is formed between the injection end and the bearing face of the valve holder and which communicates with a pressure regulator, so that the measurement of the pressure takes place as close as possible to the injection end of the fuel injection valve. This is necessary because the pressure regulator regulates the fuel pressure, or the pressure of the delivered gas as well, relative to the injection location.

DRAWING

An exemplary embodiment of the invention is shown in simplified form in the drawing and described in further detail in the ensuing description. Shown are FIG. 1, a partial cross sectional view of the exemplary embodiment with a fuel injection valve and a valve holder, both in fragmentary form;

FIG. 2, a section taken along the line II-II of FIG. 1; and

FIG. 3, a view of the valve holder in the direction of the arrow X in FIG. 1.

DESCRIPTION OF THE EXEMPLARY EMBODIMENT

Figure 1:
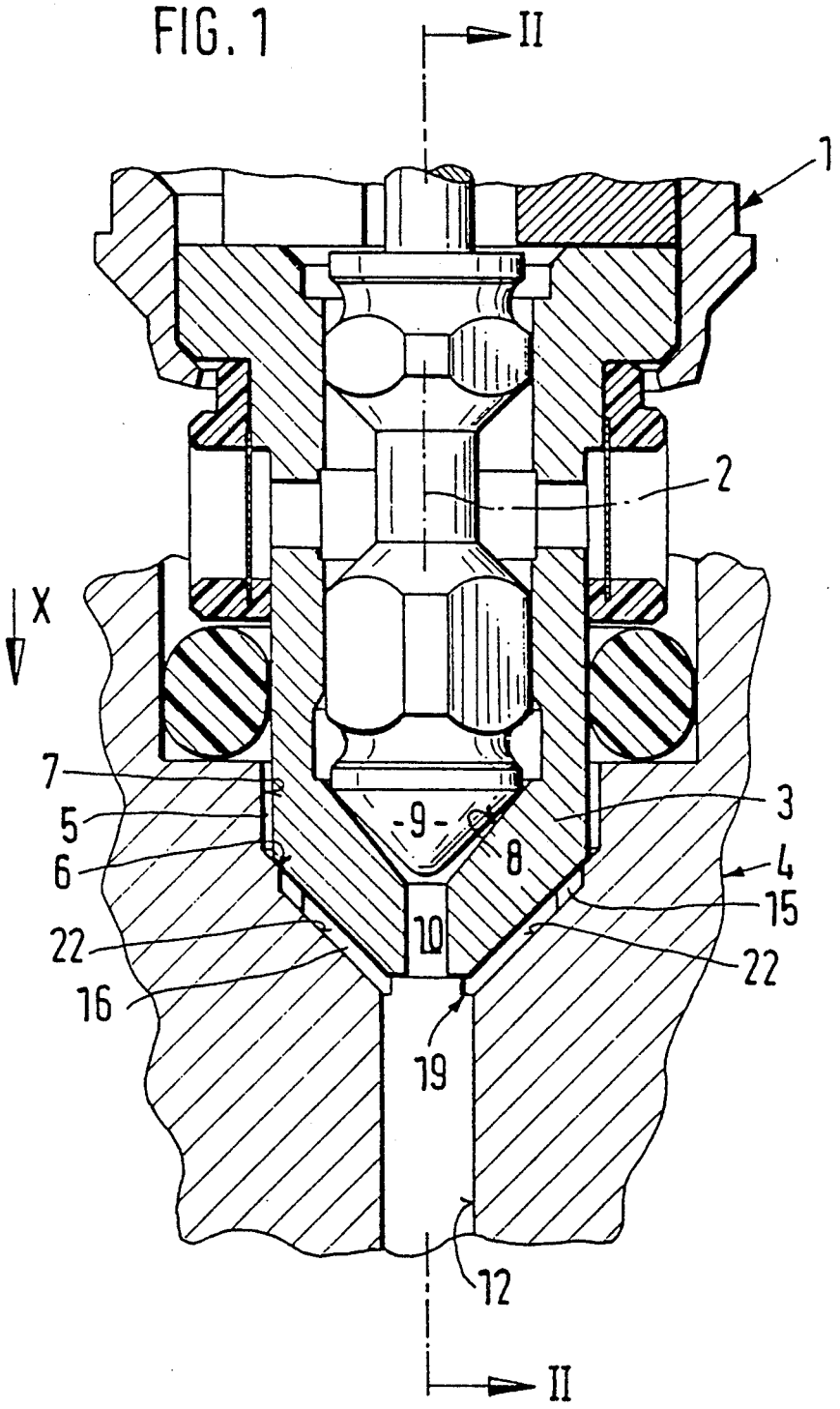

The apparatus shown by way of example in FIG. 1 for injecting a fuel-gas mixture into an intake tube or directly into a mixture-compressing internal combustion engine with externally supplied ignition has a fuel injection valve 1 that has an injection end 3, which tapers frustoconically radially to a longitudinal valve axis 2, and a valve holder 4, which has a stepped longitudinal bore 5, extending concentrically with the longitudinal valve axis 2, and surrounds the injection end 3. The injection end 3 of the fuel injection valve 1 is located partly on a bearing face 6 of the valve holder 4, which forms a portion of the longitudinal bore 5 and tapers frustoconically, radially to the longitudinal valve axis 2, and originates at a cylindrical portion 7 of the longitudinal bore 5; the bearing face 6 and the frustoconical injection end 3 extend parallel to one another. The frustoconical embodiment of the injection end 3 and of the bearing face 6 of the valve holder 4 has the effect of producing simple, yet very exact, centering of the injection end 3 of the fuel injection valve 1 in the longitudinal bore 5. The fuel injection valve 1 has a valve closing body 9 that cooperates with a fixed valve seat 8. Downstream of the valve seat 8, the injection end 3 of the fuel injection valve 1 has one injection port 10 concentric with the longitudinal valve axis 2, by way of example, but a plurality of injection ports may also be provided.

A mixing line 12, which for instance is cylindrical, is formed in the stepped longitudinal bore 5 of the valve holder 4, downstream of the injection end 3 of the fuel injection valve 1; the fuel is injected into the mixing line through the injection port 10 of the fuel injection valve 1. The mixing line 12 may discharge either into an injection line that delivers the fuel-gas mixture directly to a single cylinder of the engine or to a single location in the intake tube, or it may discharge into a mixture distributor that distributes the fuel-gas mixture to the various cylinders of the engine and delivers it to the various cylinders or the various locations in the intake tube by means of a number of injection lines corresponding to the number of cylinders.

Figure 3:
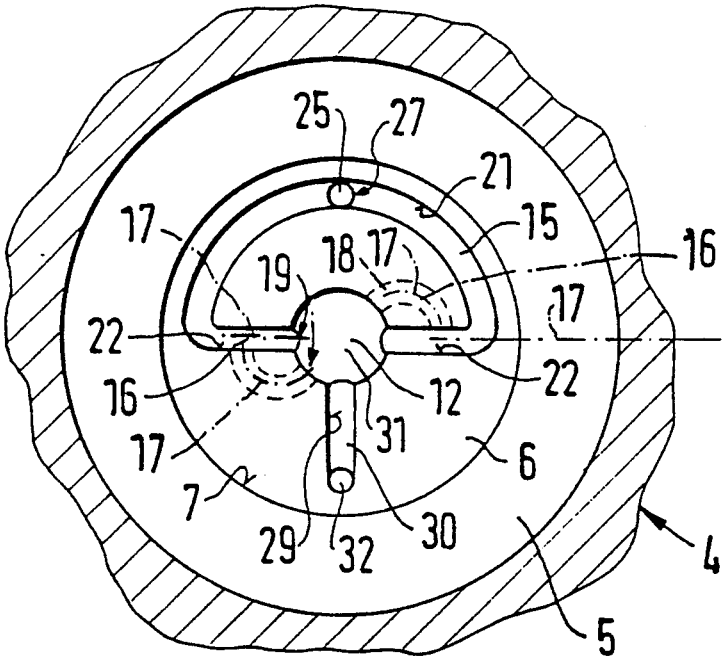

As can also be seen from FIG. 3, which shows a view of the valve holder 4 in the direction of the arrow X in FIG. 1, a semicircular annular gas conduit 15 and two gas gaps 16 originating at that conduit, the center lines 17 of the gas gaps being located in a plane through the longitudinal valve axis 2, are located between the frustoconical injection end 3 and the conically tapering bearing face 6 of the valve holder 4, on the end of the bearing face 6 remote from the mixing line 12. For this purpose, the valve holder 4 has a semicircular groove 21 in the bearing face 6; at both ends, this groove changes into a respective radial groove 22 extending along the center line 17. By installing the injection end 3 of the fuel injection valve 1 against the bearing face 6 of the valve holder 4, the grooves 21, 22 are covered by the injection end 3, thus forming the annular gas conduit 15 and the two gas gaps 16. Besides the rectangular shape shown in the drawings, both the semicircular groove 21 and the two radial gaps 22 may have any other arbitrary cross-sectional form, such as semicircular.

The two gas gaps discharge into the mixing line 12 by opposed gap openings 19, so that the radial forces produced by the gas delivery and exerted upon the fuel stream injected centrally through the injection port 10 are cancelled out and the fuel stream is not deflected.

However, if further pairs of gas gaps 16 are formed between the frustoconical injection end 3 and the conically tapering bearing face 6 of the valve holder 4, it is also possible for the gap openings 19 of the applicable pair of gas gaps 16 to discharge into the mixing line 12 opposite one another, and for the respective center lines 17 of the gas gaps 16 to be located in a plane through the longitudinal valve axis 2. To this end, as shown in dashed lines in FIG. 3, two additional grooves 18, for instance, are embodied in the bearing face 6 of the valve holder 4, branching off from the radial groove 22, for instance, and discharging into the mixing line 12. The delivery to the various pairs of gas gaps 16 may, however, also be done via a separate annular gas conduit 15 for each, in order to attain a more uniform distribution of the delivered gas to the various gas gaps 16 and to attain a uniform inflow speed into the mixing line 12. To this end, it may under some circumstances be necessary for the annular gas conduits 15 and/or the gas gaps 16 to extend in different planes of the valve holder 4.

In the exemplary embodiment shown, the gas gaps 16 discharge into the mixing line 12 in inclined fashion in the downstream direction to the longitudinal valve axis 2, because of the conically tapering bearing face 6. This improves the formation of the fuel gas mixture, because any fuel depositing on the wall of the mixing line 12 is entrained and torn away at high speed by the gas flowing downstream. The danger of an asymmetrical effect on the fuel stream is also especially low, because the gas flows into the mixing line 12 with not only the radial but also an axial directional component.

In a departure from the exemplary embodiment shown, it is also possible for the gas gaps 16 to have a cross-sectional area that varies in the direction of the gap openings 19. A cross-sectional area that decreases toward the gap openings 19, for instance, brings about an additional acceleration of the gas, so that the gas flows at high speed through the gap openings 19 into the mixing line 12 and there improves the formation of the fuel-gas mixture.

The precise centering of the injection end 3 of the fuel injection valve 1 in the longitudinal bore 5 of the valve holder 4 is a precondition for the exact, symmetrical embodiment of the gas gap 16 that serves the purposes of gas metering and gas delivery to the mixing line 12.

Figure 2:
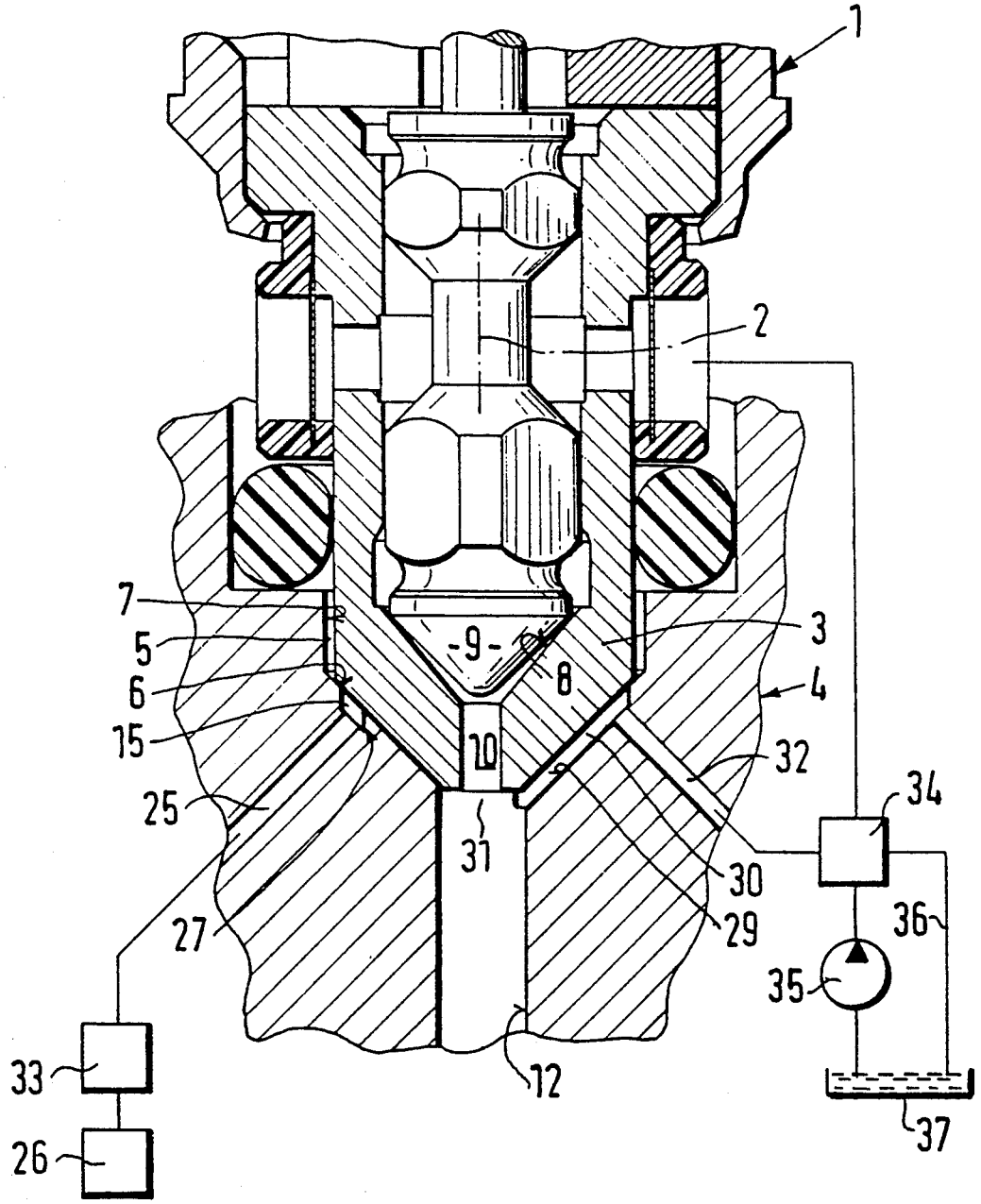

FIG. 2 shows a section taken along the line II—II of FIG. 1. The delivery of the gas to the semicircular annular gas conduit 15 takes place by means of a gas delivery conduit 25, embodied in the valve holder 4 and communicating with a gas source 26. The gas delivery conduit 25 discharges by its delivery conduit opening 27 centrally into the annular gas conduit 15, in a plane that is vertical to the two center lines 17 of the gas gap 16 and vertical to the bearing face 6.

It is also possible, however, to embody two or more gas delivery conduits 25 in the valve holder 4.

Fresh air or an inert gas or a mixture of the two can be used as the gas for forming the fuel-gas mixture. Fresh air is for instance diverted from the intake tube or an arbitrarily adjustable throttle device and delivered directly to the gas delivery conduit 25. The exhaust gas of the engine can for instance be used as inert gas, so that the toxic emissions of the engine are reduced by this exhaust gas recirculation.

As shown in FIGS. 2 and 3, a regulator gap 30 embodied in the form of a gap 29 extending in the bearing face 6 branches off from the mixing line 12 between the frustoconical injection end 3 and the conically tapering bearing face 6 of the valve holder 4; the gap 30 communicates via a regulator conduit 32, embodied in the valve holder 4, with a pressure regulator 34 that regulates the fuel pressure relative to the injection location 31 of the fuel injection valve 1. Fuel is delivered to the pressure regulator 34 by means of a fuel feed pump 35, and the return of fuel takes place via a return line 36 to the fuel tank 37. The regulator gap 30 is embodied, for instance opposite the gas delivery conduit 25, in the plane that is vertical to the two center lines 17 of the gas gaps 16. For exact regulation of the fuel pressure, it is necessary for the pressure in the mixing tube 12 to be measured particularly close to the injection end 3.

However, it is also possible for the pressure regulator 34 to regulate the delivery of the gas, and to this end to act upon a gas feed pump 33 or some other pressure generating apparatus.

When the valve holder 4 of the invention is manufactured from a metal material, the longitudinal bore 5, gas delivery conduit 25 and regulator conduit 32 are made by metal-cutting machining. The grooves 21, 22, 29 of the annular gas conduit 15, gas gaps 16 and regulator gap 30 in the conically tapering bearing face 6 of the valve holder 4 may be embodied by stamping, to lower the production costs.

Another option for producing a valve holder 4 according to the invention is to embody the valve holder 4 as a molded plastic part, resulting in especially low production costs.

The disposition of the injection end 3 of the fuel injection valve 1 resting on the bearing face 6 of the valve holder 4 and the embodiment of the annular gas conduit 15, at which two gas gaps 16 originate that have opposed gap openings 19 discharging into the mixing line 12, between the injection end 3 and the bearing face 6 enables symmetrical delivery of the gas to the centrally injected fuel stream and thus enables the formation of a maximally homogeneous fuel-gas mixture. The frustoconically embodied injection end 3, together with the bearing face 6 that tapers conically radially to the longitudinal valve axis 2 and is embodied parallel to the injection end 3 permits an exact and simple positioning of the injection end 3 relative to the mixing line 12 as well as an exact embodiment of the gas gap 16. Moreover, the apparatus according to the invention for injecting a fuel gas mixture has a compact structure.

I claim:

1. An apparatus for injecting a fuel gas mixture into an intake tube of an internal combustion engine, comprising a fuel injection valve that has a valve closing body cooperating with a fixed valve seat and downstream of the valve seat at least one injection port at one injection end, a valve holder surrounding the fuel injection valve at least in a vicinity of the injection end, the valve holder extending concentrically with the longitudinal valve axis and having a stepped longitudinal bore with a bearing face on which the injection end of the fuel injection valve rests and in which a mixing line is embodied downstream of the injection end, into which mixing line the fuel is injected through the fuel injection valve and which lines communicates upstream, via a gas gap formed between the injection end and the bearing face, with an annular gas conduit that communicates with a gas source, at least two gas gaps (16), which discharge by opposed gap openings (19) into the mixing line (12), said at least two gas gaps originate at the annular gas conduit (15).

2. An apparatus as defined by claim 1, in which two gas gaps originate at the annular gas conduit (15).

3. An apparatus as defined in claim 1, in which the center lines (17) of two gas gaps (16), discharge into the mixing line (12) by opposed gap openings (19), and are located in a plane through the longitudinal valve axis (2).

4. An apparatus as defined by claim 1, which the annular gas conduit is embodied at least semicircularly.

5. An apparatus as defined by claim 1, in which the bearing face (6) of the longitudinal bore (5) and the injection end (3) of the fuel injection valve (1) are embodied as tapering frustoconically, radially to the longitudinal valve axis (2).

6. An apparatus as defined by claim 1, which branching off from the mixing line (12) is a regulator gap (30) that is formed between the injection end (3) and the bearing face (6) of the valve holder (4).

7. An apparatus as defined in claim 2, in which the center lines (17) of two gas gaps (16), discharge into the mixing line (12) by opposed gap openings (19), and are located in a plane through the longitudinal valve axis (2).

8. An apparatus as defined by claim 2, in which the annular gas conduit (15) is embodied at least semicircularly.

9. An apparatus as defined by claim 3, in which the annular gas conduit (15) is embodied at least semicircularly.

10. An apparatus as defined by claim 2, in which the bearing face (6) of the longitudinal bore (5) and the injection end (3) of the fuel injection valve (1) are embodied as tapering frustoconically, radially to the longitudinal valve axis (2).

11. An apparatus as defined by claim 1, in which the bearing face (6) of the longitudinal bore (5) and the injection end (3) of the fuel injection valve (1) are embodied as tapering frustoconically, radially to the longitudinal valve axis (2).

12. An apparatus as defined by claim 4, in which the bearing face (6) of the longitudinal bore (5) and the injection end (3) of the fuel injection valve (1) are embodied as tapering frustoconically, radially to the longitudinal valve axis (2).

13. An apparatus as defined by claim 2, in which branching off from the mixing line (12) is a regulator gap (30) that is formed between the injection end (3) and the bearing face (6) of the valve holder (4).

14. An apparatus as defined by claim 3, in which branching off from the mixing line (12) is a regulator gap (30) that is formed between the injection end (3) and the bearing face (6) of the valve holder (4).

15. An apparatus as defined by claim 4, in which branching off from the mixing line (12) is a regulator gap (30) that is formed between the injection end (3) and the bearing face (6) of the valve holder (4).

16. An apparatus as defined by claim 5, in which branching off from the mixing line (12) is a regulator gap (30) that is formed between the injection end (3) and the bearing face (6) of the valve holder (4).

* * * * *